US009409186B2

(12) United States Patent
Kulah et al.

(10) Patent No.: US 9,409,186 B2
(45) Date of Patent: Aug. 9, 2016

(54) DIELECTROPHORETIC CELL CHROMATOGRAPHY DEVICE WITH SPIRAL MICROFLUIDIC CHANNELS AND CONCENTRIC ELECTRODES, FABRICATED WITH MEMS TECHNOLOGY

(76) Inventors: Haluk Kulah, Ankara (TR); Ata Tuna Ciftlik, Ankara (CH)

( * ) Notice: Subject to any disclaimer, the term of this patent is extended or adjusted under 35 U.S.C. 154(b) by 885 days.

(21) Appl. No.: 13/059,985

(22) PCT Filed: Jan. 20, 2009

(86) PCT No.: PCT/TR2009/000005

§ 371 (c)(1),
(2), (4) Date: Feb. 21, 2011

(87) PCT Pub. No.: WO2010/021604

PCT Pub. Date: Feb. 25, 2010

(65) Prior Publication Data

US 2011/0240473 A1 Oct. 6, 2011

(30) Foreign Application Priority Data

Aug. 22, 2008 (TR) ..... a 2008 06315

(51) Int. Cl.
*B03C 5/02* (2006.01)

(52) U.S. Cl.
CPC ..... *B03C 5/026* (2013.01)

(58) Field of Classification Search
CPC ..... G01N 27/447–27/453; G01N 27/221; B03C 5/005–5/028; B03C 7/026; B03C 5/00; B01D 57/02; B01L 2400/0424
USPC ..... 204/450–470, 546–550, 600–621, 204/641–645
See application file for complete search history.

(56) References Cited

U.S. PATENT DOCUMENTS

| | | | | |
|---|---|---|---|---|
| 5,858,192 | A * | 1/1999 | Becker et al. | 204/547 |
| 7,238,269 | B2 * | 7/2007 | Gason et al. | 204/459 |
| 2006/0290745 | A1 * | 12/2006 | Feng et al. | 347/65 |

* cited by examiner

*Primary Examiner* — Luan Van
*Assistant Examiner* — Maris R Kessel
(74) *Attorney, Agent, or Firm* — Gokalp Bayramoglu

(57) ABSTRACT

This dielectrophoretic micro cell chromatography device with concentric electrodes and spiral microfluidic channels, produced according to MEMS technology subject to this invention; is composed of 4 groups of effect electrodes, inlet electrodes, spiral zone and central span, having exterior upper electrode (1), interior sub electrode with 3D geometry (2), upper inlet electrode (3), sub inlet electrode (4), spiral zone (5), central span (6), constant reading point and Insulating wafer (7) as the main components.

10 Claims, 3 Drawing Sheets

Figure 1:
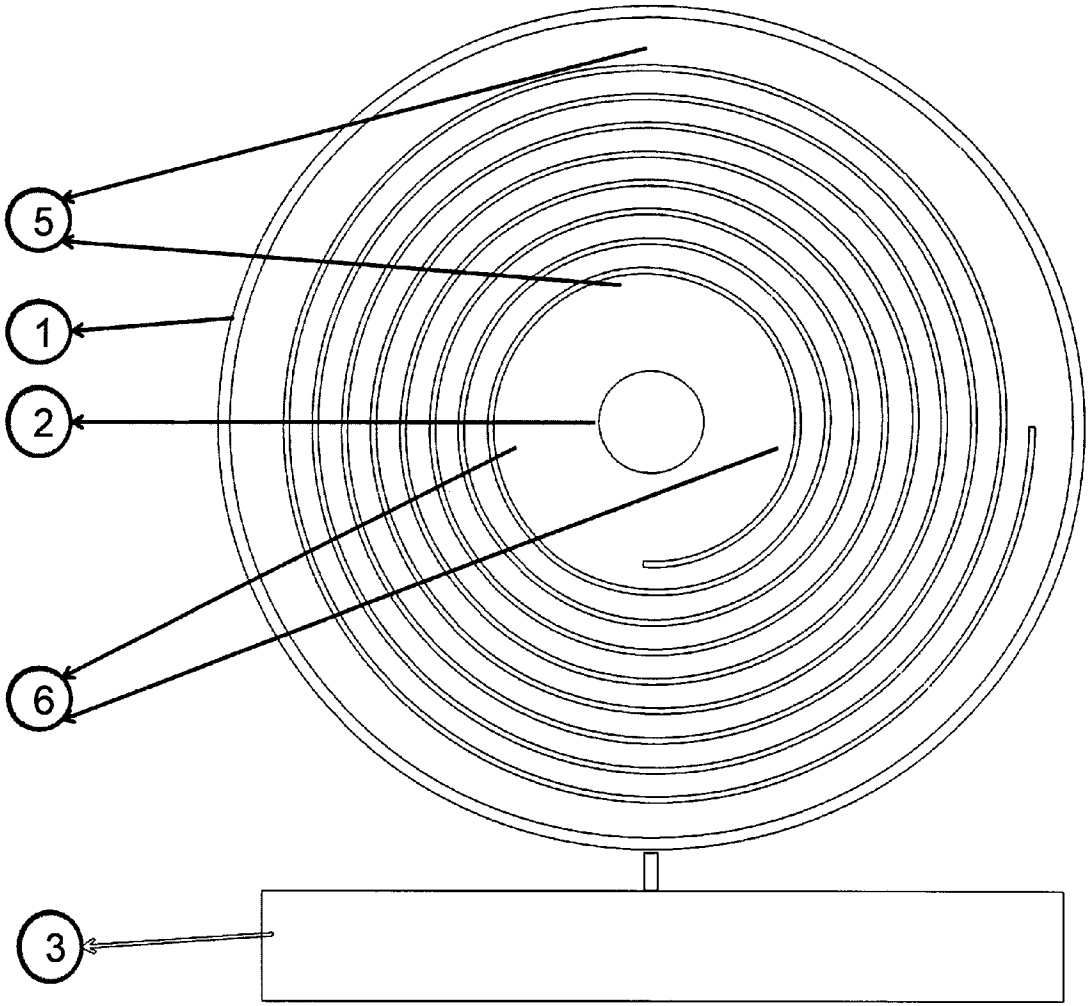

DIELECTROPHORETIC CELL CHROMATOGRAPHY DEVICE WITH SPIRAL MICROFLUIDIC CHANNELS AND CONCENTRIC ELECTRODES, FABRICATED WITH MEMS TECHNOLOGY

BACKGROUND OF THE INVENTION

Present invention relates to a chromatography device of which intended purpose is biological cell separation, performing dielectrophoresis by concentric electrodes and spiral microfluidic channels produced by micro electromechanical system (MEMS) technology.

PRIOR ART ABOUT THE INVENTION (PREVIOUS TECHNIQUE)

Dielectrophoretic characteristics of the cells may vary with many condition and disease. This study focuses on variations in these parameters caused by various cancers. By this way, early diagnosis is aimed without using time consuming and expensive genetic analysis methods. Although, there are systems devoted to certain cancer types in literature, they are designed to diagnose single type of cancer (i.e. breast cancer). In addition, while these systems operate qualitatively, they are far from yielding quantitative results. Moreover, complex electrode geometries and complex electric field application methods are used in these systems which restrict stand alone operation.

The devices introduced in the literature do not operate in parallel and individually. Since the analyses are not performed simultaneously and under identical conditions, reliability and reproducibility of the results are decreased.

On the other hand, the device subject to this invention offers a cell chromatography with dielectrophoretic methods. The device performs automated cell separation, using spiral microchannels installed in between two concentric electrodes. By this way, all cells can be subjected to separation synchronously. The device can respond to linear variations in cell parameters as time or displacement separation, a property that increases resolution significantly.

Since the devices are manufactured using Parylene Suspended Channel Technology on glass, they are cheap, demonstrate high reproducibility, and can easily be commercialized. Also, by changing the electric field characteristics, the device can be adjusted to work in single target cell mode. Similarly, by adjustment of the electric field characteristics, the device has the capacity to separate the cells with respect to their size.

By multiple parallel separation channels, the offered device can perform identical and simultaneous separations which increase reliability and reproducibility of the results.

AIMS FOR DEVELOPMENT OF THE INVENTION

With the development of the dielectrophoretic micro cell chromatography device with concentric electrodes and spiral micro fluidic channels fabricated with MEMS technology subject to this invention, a device that;

- provides high resolution
- fast
- is produced inexpensively
- has less usage costs
- low sample consumption
- enabling parallel, simultaneously and in equal conditions separation

- can be produced in high reproducibility
- small and portable
- is single use
- can work without requiring complex and expensive additional equipments
- can be used in diagnosis and treatment process of diseases such as cancer, anaemia which can be determined by cell separation
- will enable multipurpose usage through changes in voltage and frequency spectrum of applied potential.

is aimed.

The innovation offered by the main topics given above provided for the existing machines and systems according to the previous technique can be explained as follows:

- The device developed with this invention provides high resolution through using spiral micro fluid channels installed in the concentric electrodes, converting the variations in cell parameters to logarithmic separation time.
- By means of the high resolution provided, it can be used in separation of cancer cells whose parameters are very close to normal cells.
- Again by means of the high resolution provided, it may reduce diagnosis time for certain diseases, which implies the increase of possibility and success of early diagnosis.
- As it works fast, it can be utilized as a tool to determine the effectiveness of existing treatment methods (like chemotherapy), which in turn accelerates the treatment process. Existing expensive and limited diagnosis and analysis methods prevent physicians to perform these controls frequently in the treatment period.
- As it can be fabricated with a very low cost, the device will increase the access of the individuals and hospitals. Also low operational cost of the device will reduce the fixed and operational costs of diagnosis.
- Owing to the fact that the device consumes very low sample volumes to obtain a result, surgical operations can be kept at minimum levels.
- Thanks to simultaneously and equal conditioned separation feature, inaccuracies resulted from variations in ambient conditions (sample amount, heat, liquid conductivity etc.) will be controlled and highly reliable results can be obtained.
- High reproducibility of production reduces the time and cost for the post production calibration and quality control.
- Its features such as being small and portable, disposable, able to operate without requiring expensive and complex external equipments simplifies the device to be used integrated to remote health centres or military units.

THE DESCRIPTION OF THE FIGURES EXPLAINING THE INVENTION

Figure 2:
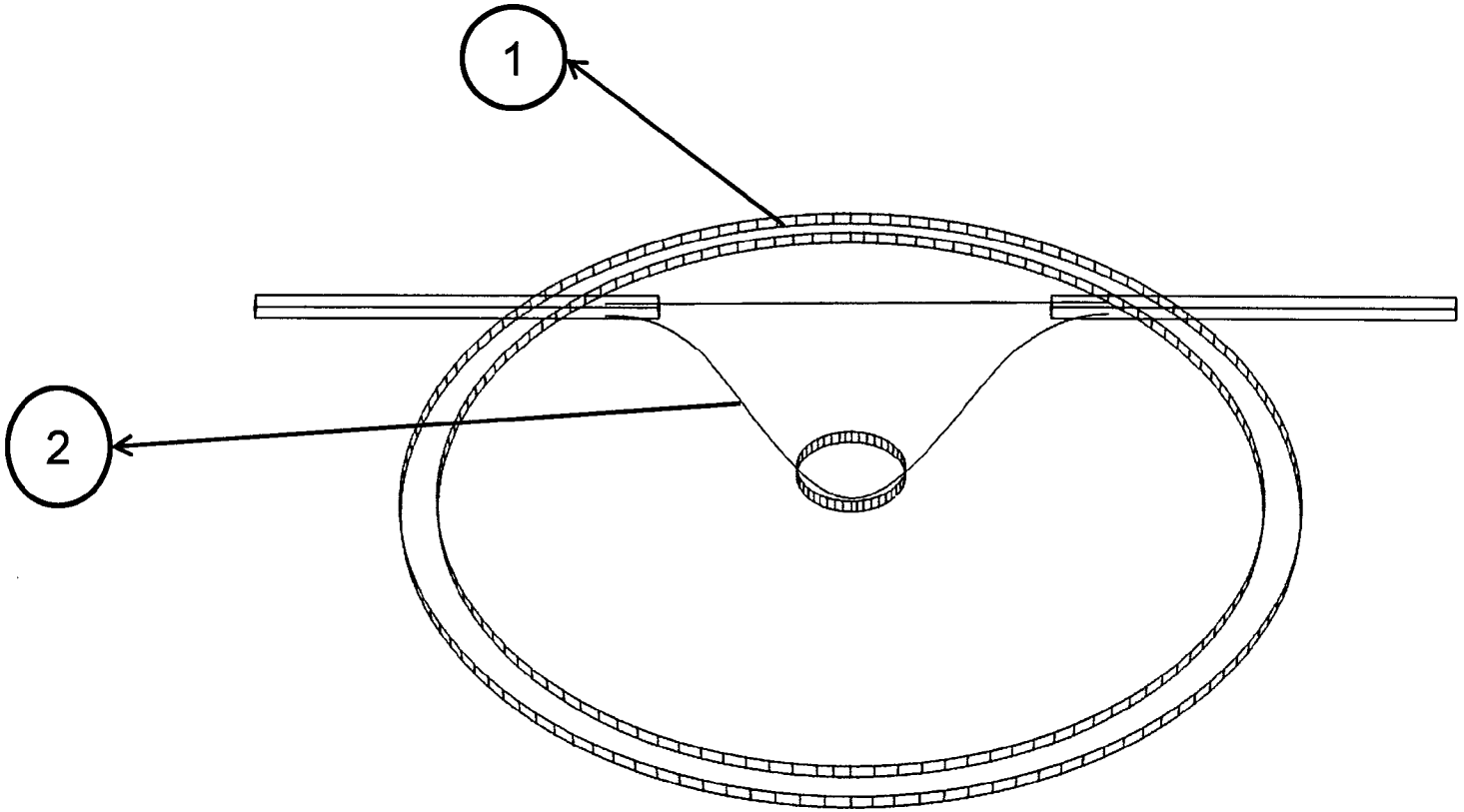
Figure 3:
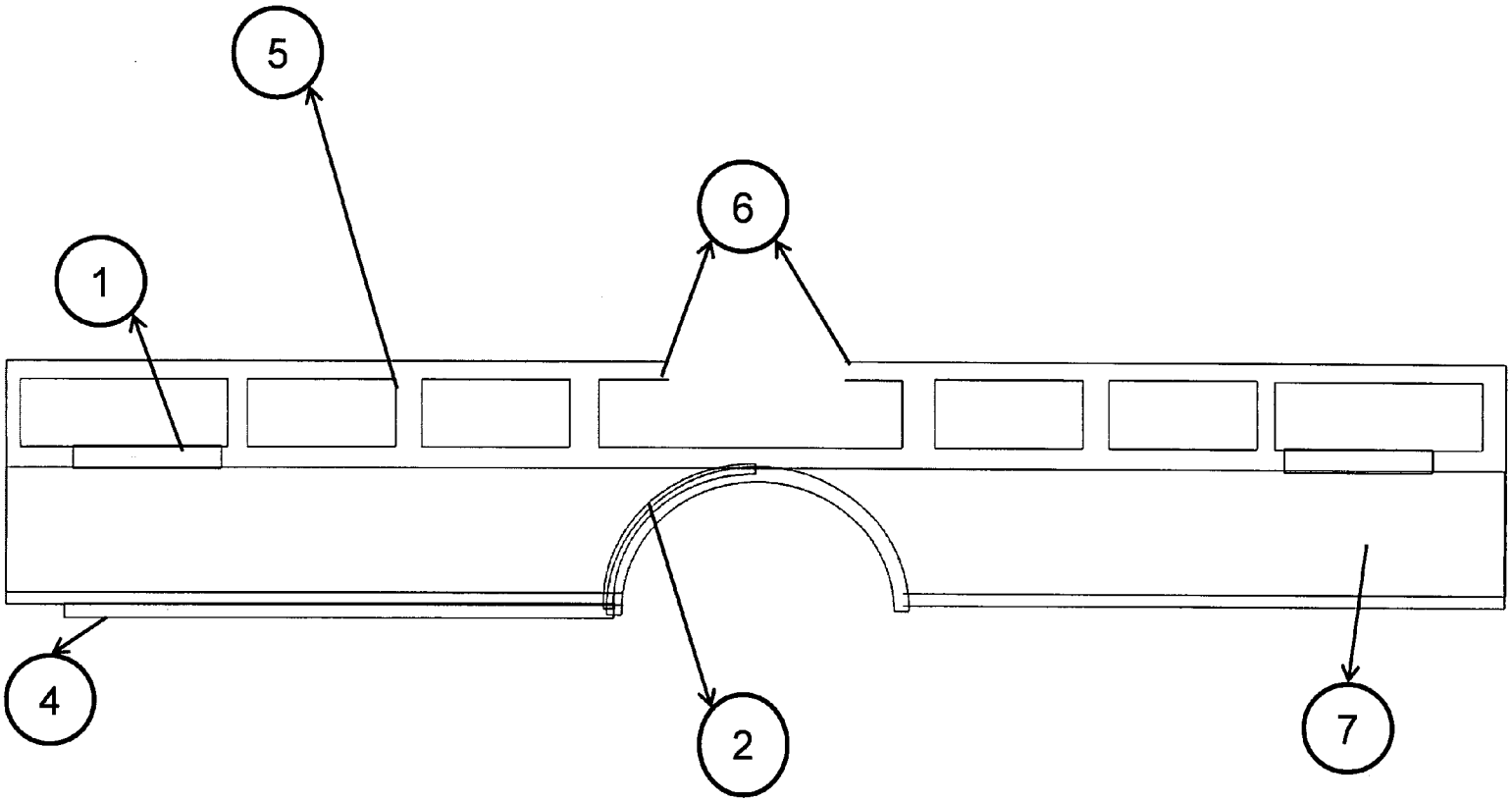

The figures prepared and annexed for a better explanation of the dielectrophoretic micro cell chromatography device with concentric electrodes and spiral micro channels, fabricated with MEMS technology subject to this invention are as follows:

FIG. 1—Plan view of the dielectrophoretic micro cell chromatography device with concentric electrodes and spiral micro channels, produced according to MEMS technology FIG. 2—Reverse perspective view of the effect electrodes FIG. 3—Section view of the dielectrophoretic micro cell chromatography device with concentric electrodes and spiral micro channels, produced according to MEMS technology

DESCRIPTION OF THE FEATURES OF THE INVENTION

The components shown in the figures prepared for a better explanation of the dielectrophoretic micro cell chromatography device with concentric electrodes and spiral micro channels, fabricated with MEMS technology improved with this invention are numbered separately and explanation of each number is given below. The illustrations are also made with colour and these parts are also numbered. Explanation of each component numbered is also given below. Additionally some parts that may hardly be understood are given separately illustrated on the figures.

1—Exterior upper electrode
2—Interior sub electrode with 3D geometry
3—Upper inlet electrode
4—Sub inlet electrode
5—Spiral Zone
6—Central span
7—Insulating wafer

DETAILED DESCRIPTION OF THE INVENTION

The main parts of the dielectrophoretic micro cell chromatography device with concentric electrodes and spiral microfluidic channel, produced according to MEMS technology improved with this invention are of 4 groups of;

Effect electrodes
Inlet electrodes
Spiral Zone
Central span

Effect electrodes are composed of exterior upper electrode (1) and interior sub electrode with 3D geometry (2) components. These electrodes are of metal film and located concentrically. Interior sub electrode with 3D geometry (2) is of parabolic structure and located towards the span at the back of the Insulating wafer (7). Exterior upper electrode (1) is located in form of a plane ring at the upper side of the spacer.

The inlet electrodes designed to apply voltage to the effect electrodes from outside are composed of Upper inlet electrode (3) and Sub inlet electrode (4). These electrodes are of metal film and while the Upper inlet electrode (3) is located at the upper side of the Insulating wafer (7), Sub inlet electrode (4) is located under the Insulating wafer (7). Both inlet electrodes have planar geometry.

Top view of the Spiral Zone (5) illustrates that, it is located between Exterior upper electrode (1) and Interior sub electrode with 3D geometry (2) and comprise micro fluidic channels with spiral geometry. These fluidic channels are located at the upper side of the Insulating wafer (7). The channels are separated from each other with non conductor polymer. Superior and inferior parts of these channels are in closed position.

Central span (6) is also a channel with a span at the superior part. Here is used to fill liquid inside the channel by capillary action and for sample cell installation procedures.

Working Principle

The device is connected to the inactivated potential source through the inlet electrodes (3 and 4). Next, applying capillary force, microfluidic channels are filled with isotonic cell solution from the central spans (6). Afterwards, the cell culture prepared or heparinized blood samples are dropped in the central spans (6). Later, in accordance with the type of the application, the potential source of alternating or direct current is started.

As the voltage is applied, firstly the cells are pulled towards the inner walls where the spiral micro fluidic channels begin. After this stage, separation starts. Within time, in connection with the differences in dielectrophoretic characteristics and due to the concentric electrodes geometry, different cells exposed to different forces and eventually start to be separated. Banding together, the cells with similar features shall stay ahead or behind in accordance with their dielectric properties.

The cells are monitored through the separation, by sensors using given electrical or optic methods at a constant point. These sensors record the time of cell arrival through preset constant reading point by quantitative and qualitative methods. At the end of the separation, a chromatograph of the cell arrival time is obtained.

As for the separation held simultaneously and in equal conditions, two or more different samples are separated in two or more channels, side by side and having equal conditions, applying same procedure. The chromatographs obtained are analyzed comparatively.

Apart from these, it is possible to conduct reference separation using micro spheres with known electrical features. This method can be used to rank the separations which have to be conducted in different time and conditions. The micro spheres of known features are mixed in both samples and separation is conducted. The chromatographs obtained are ranked as to the position of the spheres and they are compared.

The invention claimed is:

1. A dielectrophoretic cell chromatography separation device, comprising:
- an insulating wafer;
- an effect electrode comprising an exterior upper electrode in the form of a plane ring and an interior sub electrode with 3D geometry;
- wherein the exterior upper electrode and the interior sub electrode are located concentrically;
- a spiral zone located between the exterior upper electrode and the interior sub electrode and comprising a plurality of spiral microfluidic channels;
- a central span configured as a channel with a span for sample cell transition procedures; and
- an isotonic cell solution is filled in the plurality of spiral microfluidic channels;
- wherein the central span is located between the interior sub electrode and the exterior upper electrode; and
- wherein the exterior upper electrode, the interior sub electrode, the spiral zone, the plurality of spiral microfluidic channels, and the central span are located on the insulating wafer.

2. The device according to claim 1, wherein the effect electrode and the spiral zone are capable of applying an intended electric field to the the central span.

3. The device according to claim 2, wherein the spiral microfluidic channels are separated from each other with polymer walls.

4. The device according to claim 1, wherein the interior sub electrode is of parabolic structure.

5. The device according to claim 1, wherein the central span is located towards the interior sub electrode, and at the center of the spiral zone.

6. The device according to claim 5, wherein the upper part of the central span is connected with the microfluidic channels for filling liquid inside the channels by capillary force.

7. The device according to claim 1, further comprising an inlet electrode for applying voltage to the effect electrode.

8. The device according to claim 7, wherein the inlet electrode comprises an upper inlet electrode and a sub inlet electrode; and the inlet electrode has planar geometry.

9. The device according to claim 1, wherein the exterior upper electrode and the interior sub electrode are respectively located on and beneath the insulating wafer; and the spiral zone is located at the upper side of the insulating wafer.

10. The device according to claim 1, further comprising a plurality of sensors set on the inner wall of the spiral zone to record the arriving time of the sample cell; wherein the plurality of sensors work by using electrical or optical methods.

* * * * *